US005735502A

United States Patent [19]

Levett et al.

[11] Patent Number: 5,735,502

[45] Date of Patent: Apr. 7, 1998

[54] BOP WITH PARTIALLY EQUALIZED RAM SHAFTS

[75] Inventors: Bryce A. Levett, Katy; Mike C. Nicholson, Cypress, both of Tex.

[73] Assignee: Varco Shaffer, Inc., Houston, Tex.

[21] Appl. No.: 769,160

[22] Filed: Dec. 18, 1996

[51] Int. Cl.[6] ..... E21B 33/06

[52] U.S. Cl. ..... 251/1.3; 251/1.1

[58] Field of Search ..... 251/1.1, 1.3

[56] References Cited

U.S. PATENT DOCUMENTS

| | | | |
|---|---|---|---|
| 1,854,058 | 4/1932 | Otis . | |
| 2,986,367 | 5/1961 | Le Rouax . | |
| 3,036,807 | 5/1962 | Lucky et al. . | |
| 3,416,767 | 12/1968 | Blagg . | |
| 3,791,616 | 2/1974 | Le Rouax . | |
| 3,871,613 | 3/1975 | Le Rouax . | |
| 4,076,208 | 2/1978 | Olson | 251/1.3 |
| 4,214,605 | 7/1980 | Hardgrave . | |
| 4,488,703 | 12/1984 | Jones . | |
| 4,508,313 | 4/1985 | Jones . | |
| 4,519,577 | 5/1985 | Jones . | |
| 4,523,639 | 6/1985 | Howard, Jr. . | |
| 4,582,293 | 4/1986 | Jones . | |
| 4,589,625 | 5/1986 | Jones . | |
| 4,638,972 | 1/1987 | Jones et al. . | |
| 4,655,431 | 4/1987 | Helfer et al. . | |
| 4,877,217 | 10/1989 | Peil et al. . | |
| 4,976,402 | 12/1990 | Davis | 251/1.3 |
| 5,400,857 | 3/1995 | Whitby et al. . | |
| 5,575,452 | 11/1996 | Whitby et al. . | |

*Primary Examiner*—John Fox
*Attorney, Agent, or Firm*—Browning Bushman

[57] ABSTRACT

A hydraulically controlled ram assembly 12 for an oilwell blowout preventer 10 effects the opening and closing of a ram block 30 interconnected with a piston 34. The piston 34 is movable within the ram housing 22 in response to a hydraulic pressure to seal the ram block 30 with an oilfield tubular. The hollow ram shaft 36 having a central bore is sealed with a door 20 pivotally mounted to the BOP body 16 by one or more ram shaft seals 52. The cylindrical bore 60 in the ram shaft 36 is in fluid communication with the central passageway 18 in the BOP body. A ram shaft rod 70 secured to a ram housing end plate 40 extends radially inward into the bore 60 in the ram shaft 36, and is sealed to the ram shaft by one or more rod seals 72. Wellbore pressure within the BOP that opposes ram closing is thus reduced by the sealing area of the rod seal relative to the sealing area of the ram shaft seal.

20 Claims, 4 Drawing Sheets

BOP WITH PARTIALLY EQUALIZED RAM SHAFTS

FIELD OF THE INVENTION

The present invention relates to blowout preventers (BOPs) of the type commonly used in hydrocarbon recovery operations. More specifically, this invention relates to a hydraulically actuated BOP with radially opposing ram assemblies each adapted to bring a ram block into sealing engagement with an oilfield tubular. The invention also relates to a ram assembly for use in a blowout preventer.

BACKGROUND OF THE INVENTION

Hydraulically actuated BOPs have long been used in hydrocarbon recovery operations, and conventionally include radially opposing ram assemblies. Upon the application of hydraulic fluid to a piston within each ram assembly, opposing sealing blocks on the ends of ram shafts are forced radially inward into sealing engagement with an oilfield tubular. Because BOPs are primarily safety devices that operate under "blowout" conditions when fluid pressure in the well annulus exceeds expected values, BOPs require high reliability.

In order to close a BOP ram, those skilled in the art have long recognized that the applied hydraulic closing force must normally overcome the wellbore pressure in the interior of the BOP body that opposes the hydraulic force acting on the piston to move the ram radially inward. U.S. Pat. No. 1,854,058 discloses rerouting wellbore pressure from the interior of the BOP to overcome the load required to move the rams inward against the oilfield tubular. U.S. Pat. No. 2,986,367 discloses the concept of balancing the load induced by the wellbore pressure on the rams, so that the applied hydraulic fluid pressure does not have to overcome the wellbore pressure within the BOP body in order to close the rams.

By balancing the forces acting on a BOP ram, the size of pumps and other equipment associated with supplying hydraulic fluid pressure to the piston of each ram assembly may be reduced, thereby effectively reducing the cost of the BOP control system. Since less closing force is required when utilizing a pressure balanced design, smaller diameter pistons may be used in the ram assemblies, thereby also reducing the cost of manufacturing the BOP. When the BOP rams are reliably closed under a lower fluid pressure, less expensive and more reliable seals may be used for sealing between each piston and the corresponding ram housing.

A great deal of effort has thus been expended to devise different designs for pressure balancing a BOP ram shaft, so that wellbore pressure within the body of the BOP need not be overcome to close the rams. U.S. Pat. No. 3,036,807 discloses an early embodiment of a BOP with a pressure balanced concept. The BOP ram shaft includes an internal flow path for communication between the interior of the BOP body and a chamber at the rear of the ram shaft. U.S. Pat. No. 4,582,293 discloses a later-devised BOP design with a pressure balanced ram concept. The design of this patent includes a ram body with a long tubular tail end to the ram body, which significantly increases both the size and the cost of the ram assembly. U.S. Pat. Nos. 4,488,703; 4,508,313; 4,519,577; 4,523,639; and 4,638,972 each disclose alternative BOP designs that employ a pressure balancing concept including a hollow shaft with a chamber in the rear of the shaft in fluid communication with the interior of the BOP body.

U.S. Pat. No. 3,416,767 discloses a BOP with a related boosting system concept using hydraulic fluid. U.S. Pat. No. 4,655,431 also discloses a BOP that utilizes a similar pressure boosting concept for the ram assembly. U.S. Pat. No. 4,877,217 discloses a BOP with a pressure boosting concept designed to exert a higher closing force on a BOP ram. The later patent uses a hollow ram shaft and a rear chamber with an area greater than the area of the ram shaft seal subjected to the pressure within the BOP body.

U.S. Pat. Nos. 3,791,616, and 3,871,613 each disclose a BOP that uses a hollow ram shaft to support a ram sealing block thereon. U.S. Pat. No. 4,214,605 discloses a BOP utilizing a hollow ram shaft that supplies wellbore fluid to the ram piston. Accordingly to this design, the BOP may be closed using wellbore pressure that is routed to the ram piston. Yet another pressure balanced BOP design is disclosed in U.S. Pat. No. 4,589,625.

In spite of the significant effort that has been expended to date to devise an improved BOP that utilizes a design that need not overcome the full force of the wellbore pressure within the interior of the BOP body, many BOPs manufactured to date nevertheless continue to employ a design wherein the hydraulic ram closing force is to operate against the wellbore pressure within the BOP body. Part of the reason for the reluctance to accept the concepts described in the above patents relates to the high reliability required for BOPs. Many blowout preventer designs that use a balanced ram shaft concept involve complicated designs, with one or more spool valves that must reliably function in order to achieve operation of the blowout preventer. Those skilled in the art recognize that, in most cases, the fluid within the interior of the BOP body contains sand particles, heavy hydrocarbon residues, and other materials that frequently block the reliable operation of shuttle valves and fluid bypasses with small diameter ports. Other BOPs that employ a fluid pressure balanced ram include a large number of controls, and/or include numerous connections to the BOP body, each being possible leak points, for transmitting fluid pressure to the rear of the piston. Still other BOP designs utilize a ram assembly wherein it is difficult and time consuming to remove a worn ram block on the ram shaft and install a new or reconditioned ram block. Some BOP designs that benefit from a fluid pressure balanced concept make it difficult to lock-out the ram of the BOP.

The disadvantages of the prior art are overcome by the present invention, and an improved hydraulically actuated blowout preventer and a ram assembly for use in a blowout preventer are hereinafter disclosed. The blowout preventer and the ram assembly of the present invention are relatively simple yet highly rugged, and provide a highly reliable mechanism for closing a ram shaft while avoiding the problems associated with overcoming the full extent of the wellbore pressure within the interior of the BOP body.

SUMMARY OF THE INVENTION

A blowout preventer includes radially opposing ram assemblies for controlling the opening and closing of ram blocks intended for sealing engagement with an oilfield tubular passing through the blowout preventer. In an exemplary embodiment, the BOP includes radially opposing doors each pivotally connected to the BOP body, and ram assemblies mounted on each door. Each ram assembly includes an outer ram housing, and an end plate radially opposite the ram housing with respect to the door. Each ram assembly also includes a piston within the interior of the ram housing that is radially movable in response to hydraulic pressure between an open and a closed position, a ram sealing block for sealing engagement with the oilfield tubular, and a sleeve-shaped ram shaft structurally interconnecting the piston and the ram block. The radially opposing ram sealing blocks are thus each mechanically supported on the end of a ram shaft that passes through a respective BOP door and is axially movable within the ram housing along a ram axis between the open and closed positions.

A ram shaft seal is provided for sealing between a door and the ram shaft as the ram assembly moves between the open and dosed positions. The sleeve-shaped ram shaft has a bore therein extending radially outward of the ram shaft seal and in fluid communication with the central passageway in the BOP body. A ram shaft rod is fixedly secured to a ram housing end plate, and is positioned at least partially within the bore of the sleeve-shaped ram shaft. The ram shaft rod is thus cantilevered from the end plate and extends radially inward toward the ram block. A rod seal is provided for sealing between the ram shaft rod and the ram shaft as the ram assembly moves between the open and closed positions.

Wellbore pressure within the passageway in the BOP body thus does not act on the full area of the ram shalt seal. Instead, the effective pressure on the sleeve-shaped ram shaft is a function of the sealing area of the ram shaft seal less the sealing area of the rod seal. The BOP of the present invention thus minimizes the effect of wellbore pressure within the passageway in the BOP body that opposes closing of the BOP ram. This objective is accomplished by providing a hollow or sleeve-shaped ram shaft, in combination with a ram shaft rod that extends from the end plate radially inward into the bore of the sleeve-shaped ram, and a ram seal for continuing sealing between a ram shaft and the ram shaft rod as the ram assembly moves between the open and closed positions. Although the ram shaft is not fully pressure balanced, a substantial reduction in the effect of wellbore pressure in the passageway in the BOP body significantly reduces the required closing force to move the ram block into reliable sealing engagement with the oilfield tubular. Most important, this objective is accomplished without complicated spool valves, small diameter passageways that are exposed to the interior of the BOP body and are susceptible of plugging, and tubing connection that may leak during use of the BOP.

It is an object of the present invention to provide an improved blowout preventer, wherein the ram assemblies that move the ram blocks into sealing engagement with the tubular need not overcome the full force of the wellbore pressure within the BOP to close the rams. By significantly reducing the force opposing closing of the rams, the pumps or other control components external of the BOP may be reliably downsized, and the area of the ram pistons may be reduced.

It is another object of this invention to provide a highly reliable ram assembly for a blowout preventer that reduces the fluid force opposing closing of the ram in a manner which does not complicate the design of the ram assembly. A related feature of the invention is a BOP ram assembly that does not rely upon small diameter ports that may become plugged during operation of the BOP, and that do not include pressure balancing tubing and tubing connections external of the BOP body that may leak during use of the BOP.

A significant feature of the present invention is that the partially balanced ram shaft of this invention is simple and non-complicated, thereby resulting in a BOP that is highly reliable in operation. A related feature of the invention is that the overall size of the BOP ram assembly is not increased compared to prior art BOP ram assemblies that subject the rams to the full load of wellbore pressure within the BOP body that opposes closing of the ram shafts. Neither the axial length nor the exterior radial spacing required for the BOP assembly need be increased.

It is a further feature of this invention that the design of a BOP ram assembly does not complicate repair or change out of the ram blocks. Each ram assembly outer housing may be supported on a door, which in turn is pivotally connected to the BOP body. During service operations, each door may be pivoted open so that the ram block is readily accessible. The BOP and the ram assembly for use in a BOP of the present invention may be conventionally locked out in a manner common to prior art BOPs.

It is an advantage of the present invention that the BOP may be reliably operated by control systems that subject a reduced pressure to the BOP compared to prior art control systems, since the ram assembly need not overcome the full force of fluid pressure within the BOP body. Alternatively or in combination with a reduced hydraulic pressure to the BOP, the diameter of the ram piston may be reduced while still achieving reliable ram closing, thereby reducing the cost of manufacturing the BOP.

Another advantage of the present invention is that the improved BOP ram assembly may be used on existing BOPs. The ram shafts of an existing BOP may be changed out and ram shaft rods each fixed to a respective end plate of an existing BOP ram assembly.

These and further objects, features, and advantages of the present invention will become apparent from the following detailed description, wherein reference is made to the figures in the accompanying drawings.

DETAILED DESCRIPTION OF PREFERRED EMBODIMENTS

Figure 1:
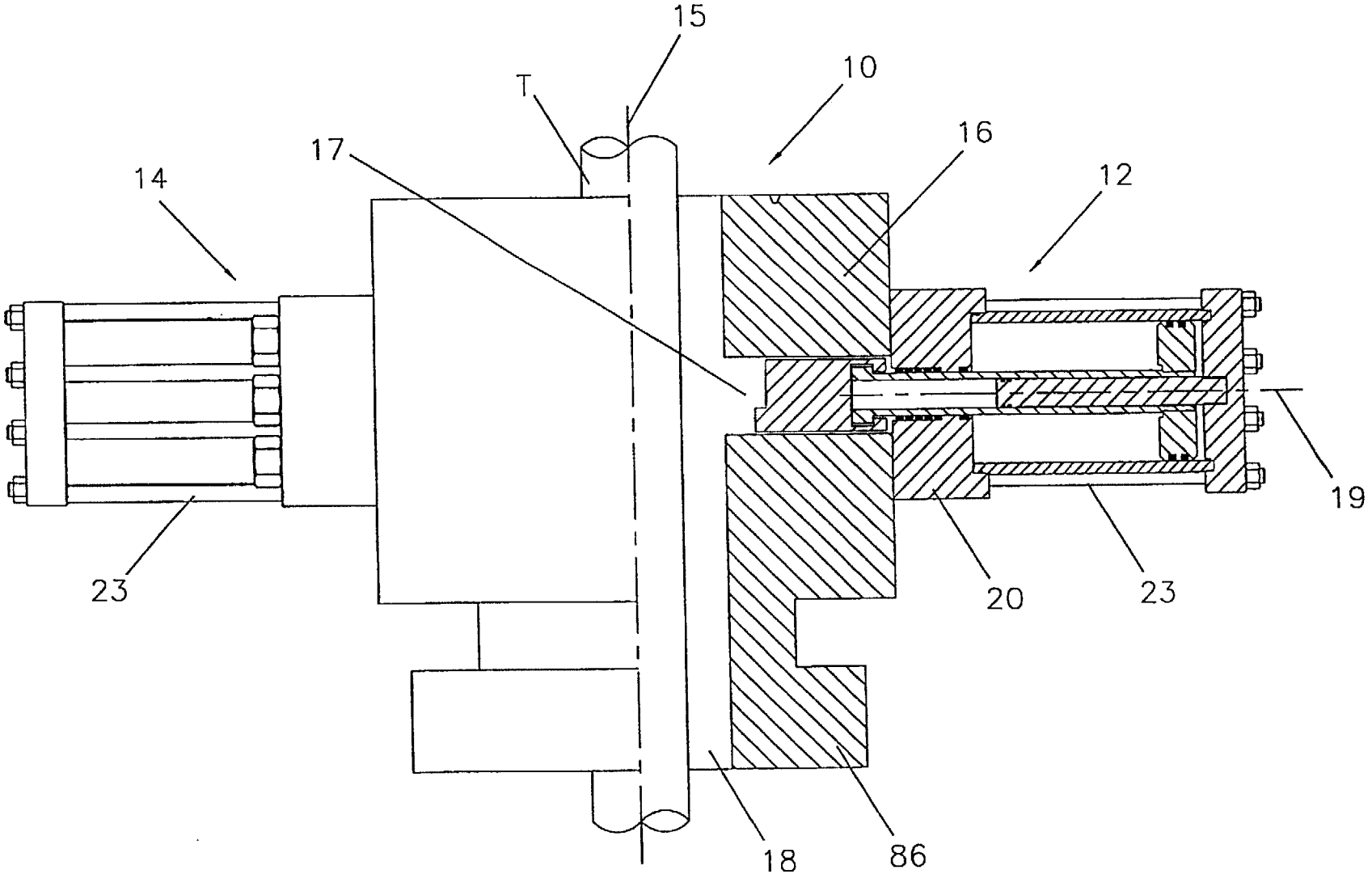
FIG. 1 is a simplified pictorial view, partially in cross-section, of a blowout preventer according to the present invention, including radial opposing ram assemblies connected to a BOP body and an oilfield tubular passing through the BOP.

FIG. 1 generally depicts a blowout preventer (BOP) 10 including a pair of radially opposing fluid powered ram assemblies 12, 14 according to the present invention. The BOP conventionally includes a body 16 having a central passageway 18 therethrough for receiving an oilfield tubular member T that passes through the BOP and into a wellbore (not shown). Those skilled in the art will appreciate that the BOP body 16 may receive tubular members of various diameters. The tubular members are generally vertical at the drilling platform on which the BOP is positioned, and may extend into a vertical, inclined or generally horizontal wellbore. Conventional ram blocks as discussed subsequently may be interchangeably installed on each ram assembly for reliably sealing during a well blowout with different oilfield tubulars within a range of diameters. The left side and right side of the BOP 10 as shown in FIG. 1 are identical, so that both a simplified pictorial view and a simplified cross-sectional view of a BOP are effectively provided in FIG. 1. Also, each ram assembly 12, 14 is preferably identical in design and construction, and accordingly the following detailed description of the ram assembly 12 should be understood to also apply to ram assembly 14.

Figure 2:
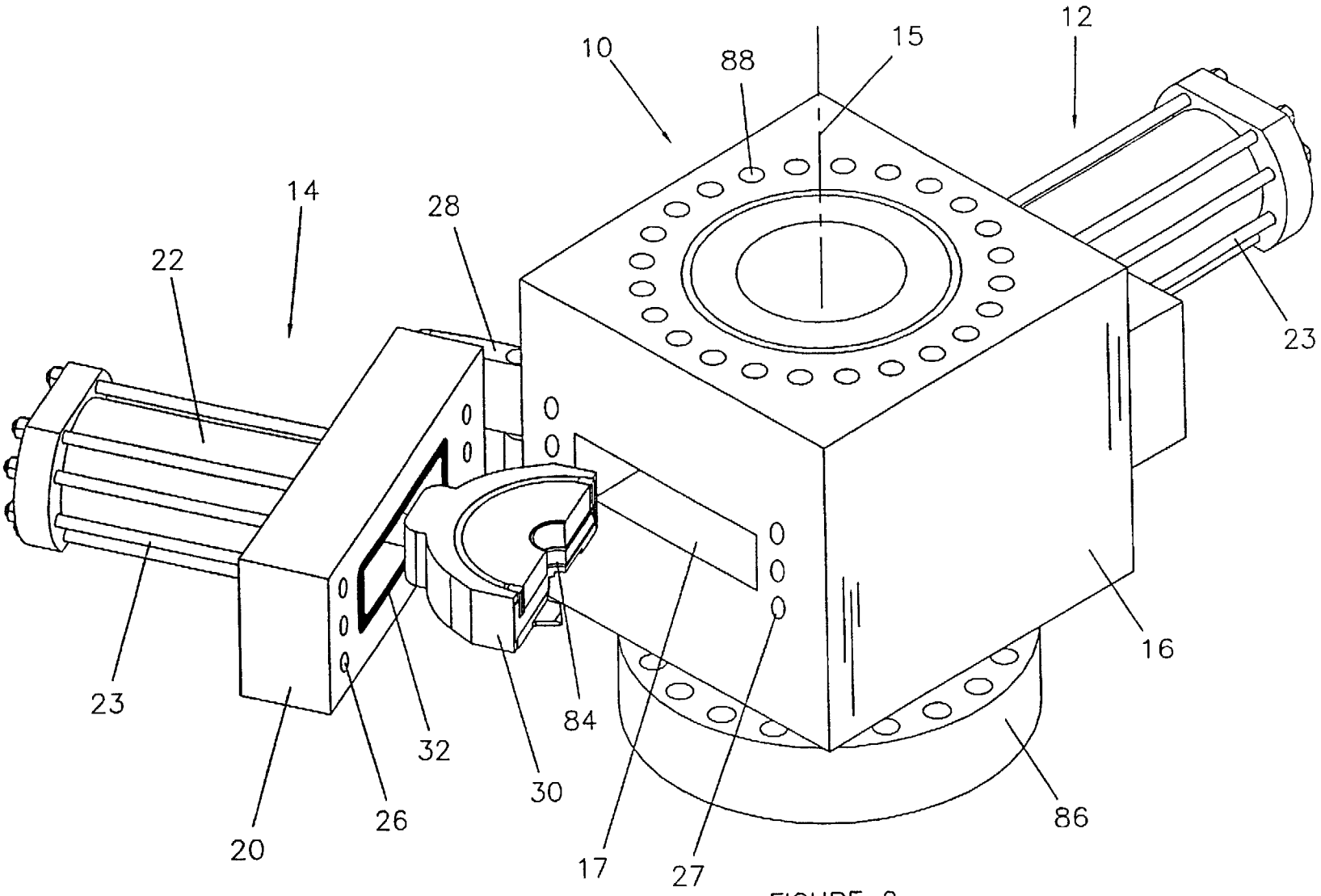
FIG. 2 is a pictorial view of the blowout preventer shown in FIG. 1, illustrating the pivotal connection between a door and the BOP body. The ram assembly is supported on the door, which may be opened for servicing the ram block.
Figure 3:
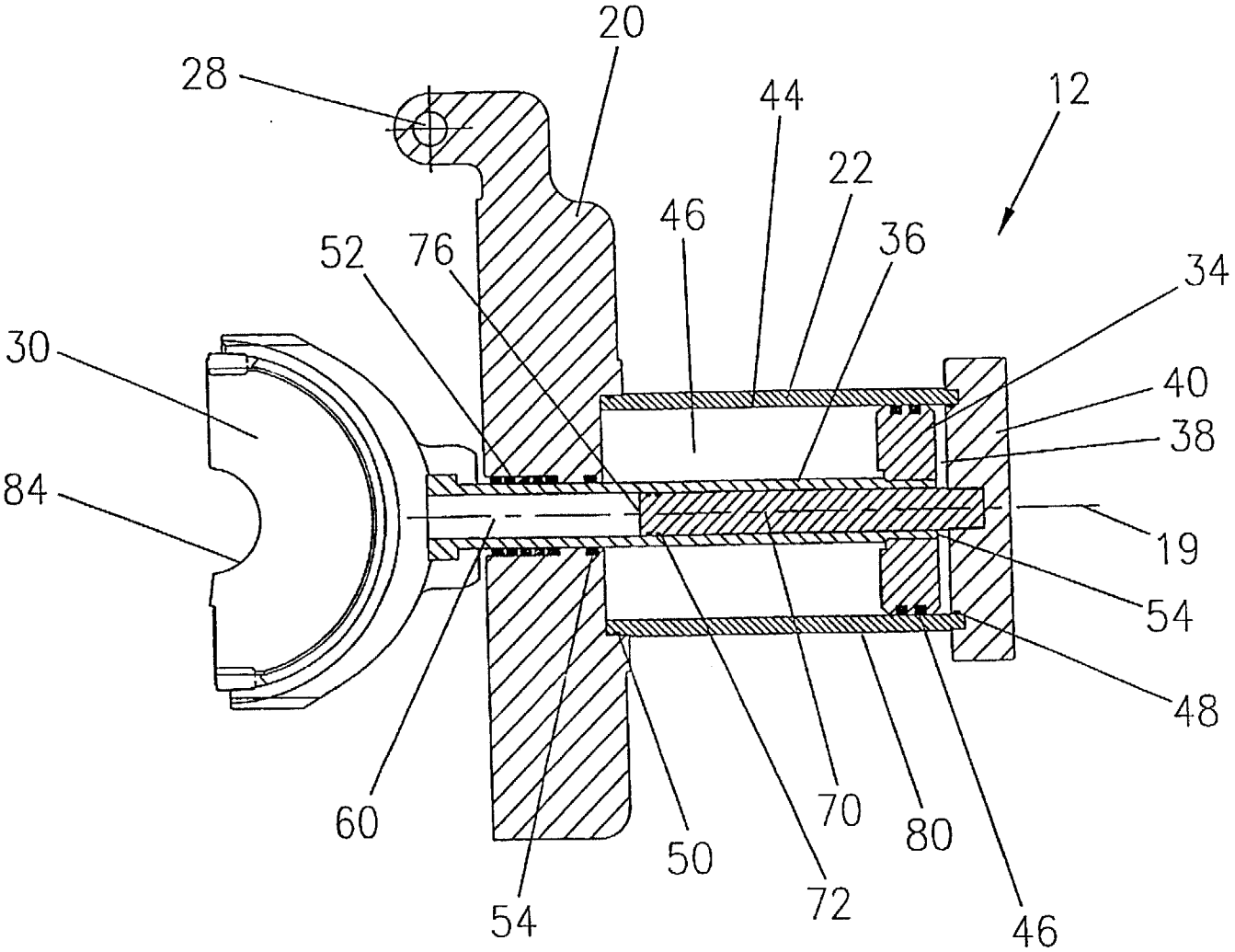
FIG. 3 is a detailed cross-sectional view illustrating the right side ram assembly as shown in FIG. 1, with the ram assembly being in the open position.

A conventional blowout preventer thus includes two structurally similar and opposing ram assemblies provided on radially opposing sides of the BOP body. Each ram assembly is in communication with a respective one of the radially opposing chambers 17 in the BOP body that extend radially outward from the central passageway 18. A radially extending central ram axis 19 of the ram assembly 12 thus passes through and is perpendicular to the central axis 15 of the BOP passageway that receives the oilfield tubular T. Each ram assembly 12 may include a generally cylindrical outer ram body 22 and a ram door 20. The outer ram body 22 as shown in FIGS. 2 and 3 may be structurally and sealingly connected by conventional bolt and nut assemblies 23 (see FIGS. 1 and 2) which extend between the end plate discussed subsequently and the ram door, as explained more fully in U.S. Pat. No. 5,575,452. Each door 20 in turn may be secured to the BOP body by conventional bolts (not shown) which pass through respective apertures 26 in the door 20 and thread to corresponding ports 27 in the BOP body 16. The ram assembly 12 may be pivotally mounted on the BOP body 16 by upper and lower pivot arms 28, thereby facilitating repair and maintenance of the ram blocks 30. Bolts in the passageway 26 may thus be unthreaded from the BOP body 16, and the door 20 and the ram assembly components supported thereon may be swung open, as shown in FIG. 2, to expose the ram sealing block 30, which may then be easily repaired or replaced. When the door 20 is subsequently closed and the bolts retightened, the seal 32 provides a static seal between a planar face of the BOP body 16 and the door 20. As shown in FIGS. 1 and 2, the lower end of the BOP body 16 may include a conventional lower flange 86 for bolted engagement with mating oilfield equipment, while the upper surface of body 16 includes circumferentially arranged threaded holes 88 for facilitating bolted engagement with a lower flange of another piece of equipment spaced above the BOP.

Figure 4:
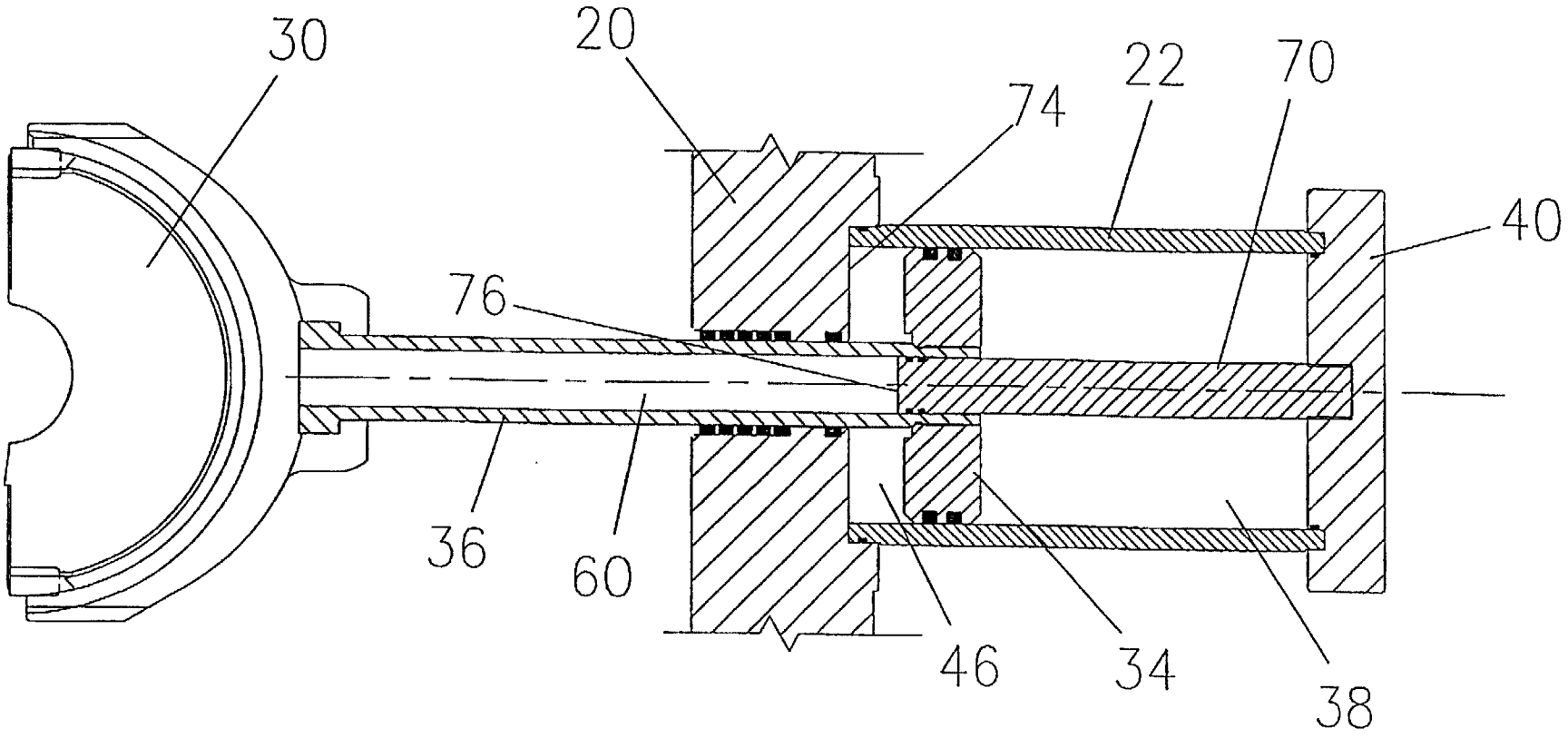
FIG. 4 is a detailed cross-sectional view illustrating a portion of the ram assembly as shown in FIG. 3, with the ram assembly being in the closed position.

As shown in FIG. 3, the ram assembly 12 includes a ram piston 34 that reciprocates along the central ram axis 19 within the outer ram body 22. A ram shaft 36 mechanically interconnects the ram piston 34 with the replaceable ram block 30. A properly sized ram block 30 is thus mounted on the end of ram shaft 36 for sealing with the oilfield tubular T to seal off an annular flow path between the BOP body and the oilfield tubular. FIG. 3 shows the ram assembly 12 in the fully open position, and FIG. 4 illustrates the same ram assembly in the closed position. Each ram assembly is fluid powered, and conventional hydraulic fluid rather than air is used as the fluid medium to obtain the high closing forces desired. Pressurized fluid in the ram closing chamber 38 thus moves the ram piston 34 and the ram block 30 structurally connected therewith to the ram closed position.

The ram housing 80 includes a generally sleeved-shaped outer ram body 22 that provides structural support between the radially outward end plate 40 and the door 20. The ram body 22 has an internal cylindrical surface 44 for sealing engagement with one or more seals 46 on the ram piston 34. Conventional fluid lines (not shown) may thus extend from a hydraulic pump (not shown) to one or more ports in the assembly 12 that provide hydraulic fluid to the ram closing chamber 38. Similar fluid lines may provide pressurized fluid to the ram opening chamber 46, which is radially inward of the piston 34. A conventional static seal 48 seals between sleeve 42 and the end plate 40, while a similar static seal 50 seals between sleeve 42 and the door 20.

As shown in FIG. 3, the hollow or sleeve-shaped ram shaft 38 is fixably secured to the piston 34 by any suitable means. In exemplary embodiments, the ram shaft 36 may be press-fitted, threaded, or secured to the piston by a nut and bolt assembly. In response to hydraulic pressure in the chamber 38, the piston moves radially inward along ram shaft axis 19 toward the centerline 15 of the BOP, thereby driving both the ram shaft 36 and the ram block 30 radially inward. When in the closed position as shown in FIG. 4, hydraulic fluid pressure may be supplied to the ram opening chamber 46 for driving the piston and thus both the ram shaft and ram block radially outward and back to the position as shown in FIG. 3. During movement of the piston and the ram assembly between the opened and the closed position, a plurality of ram shaft seals 52 supported on the door 20 provide dynamic sealing engagement with the ram shaft, thereby preventing fluid communication between the central passageway 18 within the BOP, which is open to wellbore fluids, and the opening chamber 46. While various types of ram seals 52 may be used for sealing between the door and the ram shaft, in the preferred embodiment a plurality of pressure activated lip seals 52 are spaced along the ram shaft axis 19. Also, a backup seal 54 also of the pressure activated lip seal variety may be provided as further assurance of fluid separation between the central passageway 18 and the opening chamber 46.

As previously noted, the ram shaft 36 is hollow, and preferably has a uniform diameter central bore 60 therein extending along the ram shaft axis from the ram block 30 to the radially outward end 54 of the ram shaft adjacent the piston 34. A ram shaft rod 70 is fixedly secured to the end plate 40, and extends radially inward from the end plate in a cantilevered fashion to fit within the cylindrical bore 60. Seals 72 are supported on the radially inward end of the ram shaft 70, and provide dynamic sealing engagement with the interior cylindrical surface of the ram shaft during the opening and closing operations. When in the closed position, piston 34 is positioned close to the end face 74 on the door 20, which defines the radially inwardmost surface of the opening chamber 46. In order to provide continual dynamic sealing engagement with the ram shaft 36, the ram shaft rod 70 thus must have a radial length (along the ram shaft axis 19) that is sufficient to position the seals 72 for sealing engagement with the ram shaft 36 when the ram assembly is fully closed. Since the ram assemblies of a BOP preferably do not extend radially outward of the centerline 15 any farther than necessary, the combined radial length (again along the ram shaft axis 19) of the opening chamber 46, the piston 34, and the closing chamber 38 need not be increased according to the present invention compared to a conventional ram assembly that is not partially pressure equalized.

Those skilled in the art will appreciate that if the ram shaft 36 were solid rather than hollow and the ram shaft rod 70 were not provided, the hydraulic pressure in the closing chamber 38 must be sufficient to drive the ram shaft 36 radially inward while overcoming the force of the wellbore fluid pressure in the passageway 18 acting on the seal area of the seals 52 between the ram shaft and the door. According to the present invention, the effect of wellbore fluid pressure that opposes closing of the ram is significantly reduced in proportion to the sealing area of the rod seals 72 divided by the sealing area of the ram shaft seals 52. Accordingly, much of the force of wellbore fluid pressure in the passageway 72 is transmitted to the end face 76 of the ram shaft rod, then to the end plate 40, and thus to the door 20. Wellbore fluid pressure thus effectively acts on only the annular area between the ram shaft seal 52 and the rod seal 72.

The wall thickness of the hollow ram shaft 36 must be sufficient to reliably transmit the necessary forces between the piston 34 and the ram block 30 to sealingly engage the ram block with the oilfield tubular. For most applications, this required structural integrity of the ram shaft may be accomplished with the cross-sectional sealing area of the rod seals 72 being at least 50% of the cross-sectional area of the ram seals 52. In preferred embodiments, the cross-sectional sealing area of the rod seal 72 is at least 60% of the cross-sectional sealing area of the ram shaft seal 52, so that the wellbore fluid pressure produces a force opposing closing of the ram shaft that is only 40% or less compared to the opposing force generated in prior art BOPs, where the ram shaft is solid.

According to a preferred embodiment, a cylindrical bore 60 in the ram shaft extends from the radially inward end of the ram shaft adjacent the ram block 30 to the radially outward end 54 of the ram shaft adjacent the piston 34. Those skilled in the art will appreciate that the cylindrical bore 60 need only have a length sufficient to provide dynamic sealing engagement with the rod seal 72 when the ram assembly moves between the opened and closed positions. Accordingly, that portion of the ram shaft 36 radially from the ram shaft 30 to the front end face 76 of the ram shaft rod 70 when the ram assembly is in the fully opened position need have a cylindrical bore. It is important, however, that the cylindrical bore 60 be continually in fluid engagement with the central passageway 18 within the BOP body, and that this fluid communication be provided by ports that are not likely to become plugged. Accordingly, the front portion of the ram shaft 36 may be provided with a reduced diameter bore. Also, fluid communication between the cylindrical bore 60 in the ram shaft 36 and the passageway 18 may be provided by providing one or more passageways in the front portion of the ram shaft 36 that extend outwardly through the side of the ram shaft rather than to the front end of the ram shaft adjacent the ram block 30. Those skilled in the art will appreciate that various passageway arrangements may be provided for maintaining continuous fluid communication between the passageway 18 in the BOP body and the cylindrical bore 60 in the ram shaft that extends from at least the position of the end face 76 of the ram shaft rod when the ram assembly is in the fully opened position to the radially outward end 54 of the ram shaft adjacent the piston. The arrangement as shown in FIG. 3 and 4 is preferred, however, for a reduced manufacturing cost and to achieve highly reliable operation of the BOP.

While it possible to provide sealing engagement between the rod 70 and the ram shaft 36 in an arrangement whereby the bore 60 in the ram shaft and the cross-sectional configuration of the rod 70 are not cylindrical, it is certainly preferable that sealing engagement be achieved with a cylindrical bore in the ram shaft, and that the rod 70 similarly have a cylindrical configuration. Also, the rod 70 need not have a diameter along its length between the seal 72 and the end plate 40 that is only slightly less than the diameter of the bore 60. The rod 70 could thus have an enlarged diameter radially inward end to accommodate the seals 72 for sealing engagement with the ram shaft 36, and all or a portion of the length of the rod between the enlarged diameter end and the end plate 40 could have a somewhat reduced diameter. This embodiment would reduce the weight of the ram shaft rod and possibly the cost of manufacturing the ram shaft rod. It is important, of course, that the cross-sectional area of the ram shaft rod be sufficient to reliably transmit the wellbore pressure forces acting on the end face 76 of the ram shaft rod to the end plate 40 without bending or bowing the ram shaft rod.

The method according to the present invention for closing the radially opposing ram assemblies of a blowout preventer should be apparent from the foregoing description. A bore is provided in each ram shaft 36, with the bore being in continuous fluid communication with the central passageway 18 in the BOP body. Each bore extends radially outward from a respective ram shaft seal 52 to a radially outward end of the ram shaft. First and second radially opposing ram shaft rods 70 may be removably fixed to a respective ram shaft housing, and more particularly to a respective ram housing end plate 40. Each ram shaft rod 70 is positioned within the bore in a respective sleeve-shaped ram shaft and extends radially inward from the end plate 40 toward the respective ram block. Rod seals 72 are provided for sealing between a respective ram shaft rod and the respective ram shaft as each ram assembly moves between the open and closed positions. Hydraulic fluid pressure is then applied to each of the chambers 38 for simultaneously forcing the pistons 34 and the ram blocks 30 radially inward into sealing engagement with the oilfield tubular T. While the ram assemblies are simultaneously closed, the wellbore pressure in the BOP body that opposes closing of each ram shaft is reduced as a function of the sealing area of the rod seals 72 in proportion to the sealing area of the ram shaft seals 52.

According to the present invention, each of the radially opposing doors 20 is pivotally mounted to the BOP body, with each door supporting a respective ram assembly thereon. During servicing operations, one or both of the doors 20 may be disconnected from the BOP body and the door 20 pivoted to an open position, as shown in FIG. 2, so that the radially inward end of the ram shaft 36 and the ram block 30 supported thereon may be easily serviced. If the rod seals 72 or the piston seals 46 require inspection or servicing, the end plate 40 may be removed from the outer ram body 22, and the end plate 40 and ram shaft rod 70 pulled radially outward from the ram shaft 36 to disengage these components. Piston 34 may be disconnected from the ram shaft 36 and its seals inspected and replaced, if necessary. During a servicing operation, the door 20 may be pivoted to an open position, so that with the piston 34 disconnected from the ram shaft 36, the ram shaft 36 may be pulled outwardly from the BOP body side of the door and replaced, if necessary.

As previously noted, it is a feature of the present invention that a ram assembly of an existing BOP may be modified to include the features of the present invention. A conventional ram shaft and an end plate of a ram assembly may thus be changed out, and a hollow ram shaft in accordance with the present invention and a modified end plate with a ram shaft rod 70 secured thereto may replace the prior components. As previously noted, it is desirable to size the cylindrical bore in the ram shaft and the ram shaft rod such that the cross-sectional sealing area of the rod seal 72 is at least 60% of the cross-sectional sealing area of the ram shaft seal 52, thereby significantly reducing the force of the wellbore fluid that opposes closing of the ram shaft.

Various modifications will be suggested from the foregoing disclosure. As previously noted, it is preferable that each ram assembly include a ram housing 80 that comprises a generally cylindrical outer body 22, with an internal cylindrical surface for sealing engagement with the piston, and an end plate 40. Also, it is preferably according to the present invention to provide an end plate or head plate 40 that is removably fixed to the outer body 22. In some designs, the outer body 22 may be sandwiched between the end plate 40 and the door, with bolt and nut assemblies external of the outer body 22 extending directly from the end plate 40 to the door 20.

The BOP of the present invention is preferably of the type that includes radially opposing doors 20 each pivotally mounted to the BOP body to facilitate service operations, as explained above. In other BOP designs, the door could be bolted to the BOP body so that the door was pulled off the BOP body during a servicing operation. The door provides the structural support for the ram assembly 12, which generally refers to components other than the door as shown in FIG. 3. The door 20 may be considered a component of the ram assembly in some applications, since its function is to provide structural support to the ram assembly components and to reliably seal the ram assembly with the BOP body.

Various further modifications to the ram assemblies as disclosed herein may be made while still utilizing the partially pressure balanced concept of the present invention. For example, ram assemblies could be provided with various types of locking mechanisms to mechanically lock each ram assembly in the closed position until fluid pressure was applied to the BOP for the purpose of opening each ram assembly. Suitable locking mechanisms are disclosed in U.S. Pat. Nos. 5,025,708 and 5,575,452, each hereby incorporated by reference. Those skilled in the art will appreciate that other types of locking mechanisms may be used to lock BOP ram assemblies, and may also be employed with the partially pressure balanced ram assembly of this invention.

One of the features of the present invention is that existing BOP may be retrofitted to include the ram assembly of the present invention. Since the ram assembly components are housed within the conventional ram housing, the size of the blowout preventer need not be increased. Those skilled in the art will appreciate that the various fluid flow lines supplying opening and closing pressure to the chambers 38 and 46, as well as the unlocking piston flow line, may be positioned and configured in various ways to accomplish the purposes of the invention.

The ram assemblies of the present invention are particularly well suited for sealing with the oilfield tubular, and accordingly each ram block 30 as shown in FIGS. 2 and 3 includes an elastomeric seal 84 to provide reliable sealing engagement between the ram block and the oilfield tubular. The partially pressure balanced concept of the present invention could have application in other types of ram assemblies, including particularly shearing ram assemblies of the type disclosed in U.S. Pat. No. 5,400,857.

The BOP may include a pair of opposing upper ram assemblies and a pair of lower ram assemblies with identical ram blocks if redundant operation is desired. Alternatively, the upper set of ram blocks may be provided for sealing about one size oilfield tubular, while the lower set of ram blocks may be actuated for sealing about a different size oil field tubular. In yet another embodiment, the lower ram blocks may be intended for sealing about the annulus between the oilfield tubular and the BOP body, while an upper set of ram blocks are intended to shear the oilfield tubular and completely close off any fluid flow through the BOP. Each of the pair of opposing upper and lower ram assemblies may thus be separately controlled.

Various additional modifications to the BOP and to the ram assemblies described herein should be apparent from the above description of the preferred embodiments. Although the invention has thus been described in detail for these embodiments, it should be understood that this explanation is for illustration, and that the invention is not limited to the described embodiments. Alternative components and operating techniques should be apparent to those skilled in the art in view of this disclosure. Modifications are thus contemplated and may be made without departing from the spirit of the invention, which is defined by the claims.

What is claimed is:

1. A hydraulically actuated blowout preventer for engagement with an oilfield tubular, comprising:

a BOP body having a central passageway for receiving the oilfield tubular and radially opposing chambers extending radially outward from the central passageway, the central passageway in the BOP body defining a BOP central axis;

first and second ram assemblies each in communication with a respective chamber in the BOP body, each of the first and second ram assemblies including a ram housing sealing connected to the BOP body, a piston movably responsive to hydraulic pressure within the ram housing between an open position and a closed position, a ram block, and a sleeve-shaped ram shaft interconnecting the piston and the ram block;

first and second ram shaft seals each for sealing between a respective ram housing and a respective ram shaft as each ram assembly moves between the open and closed positions;

each sleeve-shaped ram shaft having a bore therein in fluid communication with the central passageway in the BOP body and extending radially outward from the respective ram shaft seal to a radially outward end of the ram shaft;

first and second ram shaft rods each fixedly secured to a respective ram housing and positioned within the bore in a respective sleeve-shaped ram shaft, each ram shaft rod extending radially from the respective ram housing toward the respective ram block; and first and second rod seals each for sealing between a respective ram shaft rod and a respective ram shaft as each respective ram assembly moves between the open and closed positions, such that fluid pressure in the BOP passageway opposes closing of each ram shaft as a function of the sealing area of the respective ram shaft seal less the sealing area of the respective rod seal.

2. The blowout preventer as defined in claim 1, further comprising:

first and second doors each removably secured to the BOP body and supporting a respective ram assembly thereon, a respective one of the first and second ram shaft seals for sealing between a respective door and a respective ram shaft; and the first and second ram assemblies each include an end plate radially opposite the BOP body with respect to the respective door, the respective ram shaft rod being fixedly secured to the respective end plate.

3. The blowout preventer as defined in claim 2, wherein each of the first and second doors is pivotally mounted to the BOP body, such that each door may be pivotally opened for servicing the respective ram block.

4. The blowout preventer as defined in claim 2, wherein each ram assembly further comprises:

the ram housing includes a generally cylindrical outer ram body extending radially between a respective door and a respective end plate; and the ram housing including a cylindrical interior surface thereon for sealing engagement with a respective piston.

5. The blowout preventer as defined in claim 2, wherein each ram shaft seal is supported on a respective door for dynamic sealing engagement with a respective ram shaft, and each rod seal is supported on a respective ram shaft rod for dynamic sealing engagement with a respective ram shaft.

6. The blowout preventer as defined in claim 1, wherein each rod seal has a cross-sectional area of at least 60% of the cross-sectional area of a respective ram shaft seal.

7. The blowout preventer as defined in claim 1, wherein the bore in each ram shaft has a substantially cylindrical configuration extending radially between the respective ram block and the radially outward end of the ram shaft.

8. The blowout preventer as defined claim 1, wherein each ram shaft has a shaft receiving portion positioned within the respective ram shaft when the respective ram assembly is in the open position, the shaft receiving portion having a substantially uniform diameter.

9. The blowout preventer as defined in claim 1, wherein each ram shaft rod is removably threaded to a respective ram shaft housing.

10. The blowout preventer as defined in claim 1, wherein the ram block includes an elastomeric seal for sealing engagement of the ram block and the oilfield tubular.

11. A ram assembly for positioning on a BOP body having a passageway therein for receiving an oilfield tubular, the ram assembly comprising:

a ram housing for sealing with the BOP body and having a ram cavity therein in communication with the passageway in the BOP body, the ram housing including a radially outward end plate;

a ram piston movably responsive to hydraulic pressure within the ram cavity between an open position and a closed position;

a ram block for sealing engagement with the oilfield tubular when the ram piston is in the closed position;

a sleeve-shaped ram shaft interconnecting the ram piston and the ram block;

a ram shaft seal for sealing between the ram housing and the ram shaft as the ram piston moves between the open position and the closed position;

the sleeve-shaped ram shaft having a bore therein in fluid communication with the central passageway in the BOP body and extending radially outward to a radially outward end of the ram shaft;

a ram shaft rod fixedly secured to the ram housing and positioned within the bore in the sleeve-shaped ram shaft, the ram shaft rod extending from the end plate radially toward the ram block; and a rod seal for sealing between the ram shaft rod and the ram shaft as the ram piston moves between the open position and the closed position, such that fluid pressure in the BOP passageway opposes closing of the ram shaft as a function of a sealing area of the ram shaft seal less the sealing area of the rod seal.

12. The ram assembly as defined in claim 11, further comprising:

a door for securing the BOP body and supporting the ram housing thereon, the ram shaft seal sealing between the door and the ram shaft; and the door being adapted for pivotal mounting to the BOP body such that the door may be pivotally opened for servicing the ram block.

13. The ram assembly as defined in claim 12, wherein the ram shaft seal is supported on the door for dynamic sealing engagement with the ram shaft, and the rod seal is supported on the ram shaft rod for dynamic sealing engagement with the ram shaft.

14. The ram assembly as defined in claim 11, wherein the rod seal has a cross-sectional area of at least 60% of the cross-sectional area of the ram shaft seal.

15. The ram assembly as defined in claim 11, wherein the bore in the ram shaft has a substantially cylindrical configuration extending radially between the ram block and the radially outward end of the ram shaft.

16. The blowout preventer as defined claim 11, wherein the ram shaft has a shaft receiving portion positioned within the respective ram shaft when the respective ram assembly is in the open position, the shaft receiving portion having a substantially uniform diameter.

17. A method of closing first and second radially opposing ram assemblies of a blowout preventer to engage an oilfield tubular, the blowout preventer including a BOP body having a central passageway for receiving the oilfield tubular, first and second ram housings each sealing connected to the BOP body, first and second pistons each movably responsive to hydraulic pressure within the ram housings, first and second ram blocks, first and second ram shafts each interconnecting a respective piston and a respective ram block, and first and second ram shaft seals each for sealing between a respective ram housing and a respective ram shaft as each ram assembly moves between the open and closed positions, the method comprising:

providing a bore in each ram shaft in fluid communication with the central passageway in the BOP body and extending radially outward from the respective ram seal to a radially outward end of the ram shaft;

securing first and second ram shaft rods each to a respective ram housing and positioned within the bore in a respective sleeve-shaped ram shaft, each ram shaft rod extending radially from the respective ram housing toward the respective ram block;

providing first and second rod seals each for sealing between a respective ram shaft rod and a respective ram shaft as each respective ram assembly moves between the open and closed positions; and pressurizing the first and second ram housings to move the first and second pistons and the first and second ram blocks radially inward, while fluid pressure in the BOP passageway opposes closing of each ram shaft as a function of the sealing area of the respective ram shaft seal less the sealing area of the respective rod seal.

18. The method as defined in claim 17, further comprising:

pivotally mounting first and second doors to the BOP body, each door supporting a respective ram assembly thereon;

positioning the first and second ram shaft seals for sealing between a respective door and a respective ram shaft; and disconnecting at least one of the first and second doors and the BOP body to pivot the disconnected door to an open position and service the respective ram block.

19. The method as defined in claim 17, further comprising:

supporting each ram shaft seal on a respective door for dynamic sealing engagement with a respective ram shaft; and supporting each rod seal on a respective ram shaft rod for dynamic sealing engagement with a respective ram shaft.

20. The method as defined in claim 17, further comprising:

sizing each rod seal to have a cross-sectional area of at least 60% of the cross-sectional area of a respective ram shaft seal.

* * * * *